US006708653B2

(12) United States Patent
Lefrançois et al.

(10) Patent No.: US 6,708,653 B2
(45) Date of Patent: Mar. 23, 2004

(54) FLUID RESERVOIR

(75) Inventors: Gilbert Lefrançois, Canton Magog (CA); Daniel Duceppe, Rock Forest (CA); Jean Daunais, Granby (CA)

(73) Assignee: Bombardier Recreational Products Inc., Montreal (CA)

( * ) Notice: Subject to any disclaimer, the term of this patent is extended or adjusted under 35 U.S.C. 154(b) by 0 days.

(21) Appl. No.: 10/126,462

(22) Filed: Apr. 29, 2002

(65) Prior Publication Data

US 2002/0157621 A1 Oct. 31, 2002

Related U.S. Application Data

(60) Provisional application No. 60/286,723, filed on Apr. 27, 2001.

(51) Int. Cl.[7] ..... F01P 3/22
(52) U.S. Cl. ..... 123/41.54; 165/104.32
(58) Field of Search ..... 123/41.54; 165/104.32

(56) References Cited

U.S. PATENT DOCUMENTS 3,741,172 A * 6/1973 Andreux ..... 123/41.54
3,809,150 A * 5/1974 Holmes ..... 123/41.54
4,273,563 A * 6/1981 Fadda et al. ..... 123/41.54
4,480,598 A * 11/1984 Berrigan ..... 123/41.54
4,723,596 A * 2/1988 Spindelboeck et al. .. 123/41.54
4,739,730 A * 4/1988 Jenz et al. ..... 123/41.54
4,787,445 A * 11/1988 Howcroft ..... 123/41.54
5,044,430 A * 9/1991 Avrea ..... 123/41.54
5,163,506 A * 11/1992 Attinger et al. ..... 123/41.54
5,219,022 A * 6/1993 Martenas et al. ..... 123/41.54
5,357,909 A * 10/1994 Attinger et al. ..... 123/41.54
6,216,646 B1 * 4/2001 Smith et al. ..... 123/41.54

* cited by examiner

*Primary Examiner*—Henry C. Yuen
*Assistant Examiner*—J G Benton
(74) *Attorney, Agent, or Firm*—BRP Legal Services

(57) ABSTRACT

A valve in the flow aperture of a removable coolant reservoir enables coolant to flow between the reservoir and a coolant system while preventing the coolant in the reservoir from spilling when the reservoir is disconnected from the coolant system. A filling tube with a lower end and an air escape passage discourage users from overfilling the reservoir. Once the coolant level reaches the lower end, fluid accumulates in the filling tube, thereby indicating to the user that the reservoir is full. The air escape passage then gradually allows displaced air to escape and coolant in the filling tube to enter the reservoir. An overflow port and tube attached to the filling tube divert excess coolant away from the reservoir. A bleed tube, a bleed port, and a barrier in the reservoir remove bubbles from the coolant system and prevent the removed bubbles from reentering the coolant system.

40 Claims, 6 Drawing Sheets

FLUID RESERVOIR

CROSS-REFERENCE

This application claims the benefit of priority to U.S. Provisional Patent Application No. 60/286,723 titled "COOLANT RESERVOIR VALVE FOR ENABLING REMOVAL OF RESERVOIR WITHOUT COOLANT LOSS," filed on Apr. 27, 2001, which is incorporated herein by reference.

FIELD OF THE INVENTION

The present invention relates to a fluid reservoir for a closed loop fluid system such as, for example, is associated with an internal combustion engine.

BACKGROUND

Closed loop coolant circulation systems are typically used in conjunction with vehicle engines to dissipate heat that builds up in and around the vehicle engine. Because the coolant expands and contracts during normal operation of the coolant circulation system, a coolant reservoir is typically provided to allow excess coolant to flow into the reservoir and allow coolant in the reservoir to flow into the circulation system when additional coolant is required to fill the circulation system. Typically, this occurs as the coolants' temperature fluctuates. Specifically, as the coolant's temperature decreases, it tends to contract. The use of a coolant reservoir allows the coolant to flow therein as the temperature increases, and also allows the fluid therein to flow back into the system as the temperature decreases.

In order for the coolant reservoir to facilitate the flow of coolant between the coolant circulation system and the reservoir, a flow aperture connecting the reservoir to the coolant system is typically disposed at a bottom portion of the reservoir such that the system is gravity fed. Unfortunately, positioning the flow aperture at the bottom of the reservoir makes disconnection and removal of the reservoir from the circulation system difficult to accomplish without spilling at least some coolant. If the coolant circulation system is used in a vehicle having a confined space for the engine components such as a personal watercraft (PWC), the reservoir must often be disposed in a position where it must be removed in order to access the engine. When conventional reservoirs are disconnected from the coolant systems to access the engine, the flow aperture becomes exposed to the ambient environment and coolant leaks out of the reservoir unless and until the user somehow seals the flow aperture. To avoid coolant leaks, conventional coolant systems are drained before removing the coolant reservoir. However, draining the entire coolant system prior to removing the reservoir is both inconvenient and time-consuming.

The efficiency of coolant circulation systems depends on maximizing the amount of coolant flowing through the system. Consequently, any bubbles that develop and accumulate in the fluid path reduce the efficiency of the coolant system. To minimize the presence of such bubbles, conventional coolant systems typically have bleed tubes that connect the highest point in the coolant system, which is where bubbles accumulate, to the coolant reservoir in order to encourage the bubbles to flow out of the coolant path and through the bleed tube into the reservoir. Unfortunately, because the reservoir is itself connected to the fluid loop, it is possible for the bubbles to merely flow back into the coolant path through the flow aperture connecting the reservoir to the coolant path. The flow of bubbles back into the coolant path reduces the efficiency of the system and defeats the purpose of the bleed tube.

Conventional coolant reservoirs are provided with filling tubes that allow a user to add more coolant to the coolant system. Unfortunately, users may accidentally overfill the reservoir with coolant by filling the reservoir above the maximum desired coolant level or by filling the reservoir above the upper rim of the filling tube. When the reservoir is filled to the maximum desired coolant level, the expansion of the coolant during operation of the coolant system may force even more coolant into the reservoir and cause the coolant to overflow. As a result, when the reservoir is filled by a user above the maximum level, excess coolant may spill out and harm engine components or make a mess.

SUMMARY OF THE INVENTION

The present invention prevents spills and/or inconveniences from occurring when the reservoir is disconnected by providing a vehicle with a fluid system defining a fluid path through which a fluid flows. The vehicle includes a removable fluid reservoir that has a container defining a fluid receiving interior space and having a flow aperture (or opening). The reservoir is removably connected to the fluid path to allow for fluid communication between the interior space of the container and the fluid path via the flow aperture. A valve is mounted to the container at the flow aperture.

The valve may be a manually operable ball valve. Before removing the reservoir from the coolant system, a user need only close the valve to avoid leaks. Alternatively, the valve may be a pressure-activated valve that is mounted at the flow aperture to enable the fluid to flow from the fluid path into the interior space of the container via the flow aperture to compensate for a pressure increase within the fluid path. The pressure-activated valve substantially prevents the fluid in the interior space of the container from flowing out through the flow aperture when the container is disconnected from the fluid system.

The present invention substantially prevents bubbles from reentering the coolant path once the bubbles have entered the reservoir by providing a vehicle that has a fluid system defining a fluid path through which a fluid flows. The first end of a bleed tube has first and second ends operatively connected to the fluid path. A fluid reservoir has a container defining an interior space. A barrier partially separates the interior space into first and second lateral interior spaces. A bleed port operatively connects an upper portion of the second interior space to the second end of the bleed tube such that air bubbles that have accumulated in the fluid path flow through the bleed tube and port into the second lateral interior space. The barrier is constructed to discourage air bubbles in the second lateral interior space from entering the first lateral interior space. A fluid passage operatively connects lower portions of the first and second lateral interior spaces to permit a substantially bubbleless fluid in the lower portion of the second interior space to flow into the first lateral interior space. A passage between the lower portion of the first interior space and the fluid path permits the fluid in the first interior space to flow into the fluid path.

The present invention discourages overfilling and prevents associated spills by providing a vehicle having a fluid system defining a fluid path through which a fluid is circulated. The vehicle includes a fluid reservoir operatively connected to the fluid path. The fluid reservoir comprises a container defining a fluid receiving interior space and having a flow aperture that allows for communication between the interior space of the container and the fluid path. The reservoir has a hollow filling tube having (a) an upper end into which fluid may be added and (b) a lower end disposed within the interior space at a vertical position generally corresponding to a maximum desired fluid level. The filling tube enables air that is displaced during fluid filling to escape from the interior space to an ambient environment through the lower end until a fluid level in the interior space reaches the lower end. After the fluid level has risen above the lower end, added fluid accumulates in the fluid filling tube. An air escape passage has first and second ends, the first end of which communicates with the interior space. Because the passage has a cross-sectional area substantially smaller than a cross-sectional area of an inside of the filling tube, the escape passage enables air to gradually escape from the interior space through the escape passage and fluid accumulated in the filling tube to gradually flow into the interior space when the fluid level is above the lower end.

The reservoir according to the present invention may further include an overflow port at an upper portion of the fluid filling tube to prevent excess coolant from spilling out of the reservoir. An overflow tube is removably operatively connected to an external end of the overflow port to permit excess vapor and fluid in the fluid filling tube to flow through the overflow port and tube into a predetermined location such as the bottom of a hull in the case of a personal watercraft (PWC).

The second end of the air escape passage may communicate with a portion of the fluid filling tube intermediate the upper and lower ends thereof. Alternatively, the second end of the air escape passage may be operatively connected to the overflow port and/or tube.

Other objects, features, and advantages of the present invention will become apparent from the following description, the accompanying drawings, and the appended claims.

BRIEF DESCRIPTION OF THE DRAWINGS

For a better understanding of the present invention as well as other objects and further features thereof, reference is made to the following description which is to be used in conjunction with the accompanying drawings, where.

DETAILED DESCRIPTION OF THE PREFERRED EMBODIMENTS OF THE INVENTION

Figure 1A:
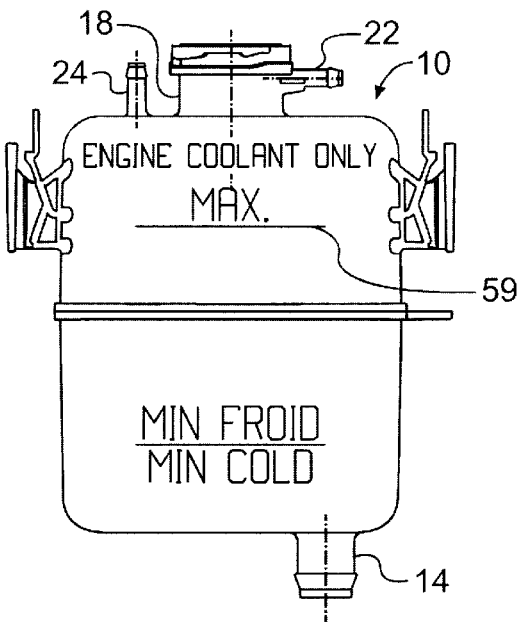
FIGS. 1A, 1B, 1C, and 1D are front, side, back and top plan views, respectively, of a coolant reservoir according to the present invention.
Figure 1B:
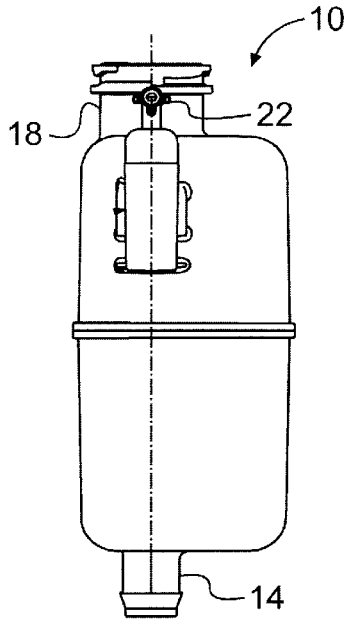
Figure 1C:
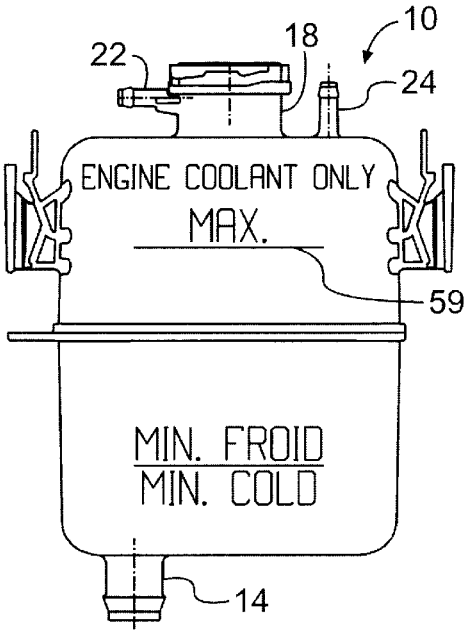
Figure 1D:
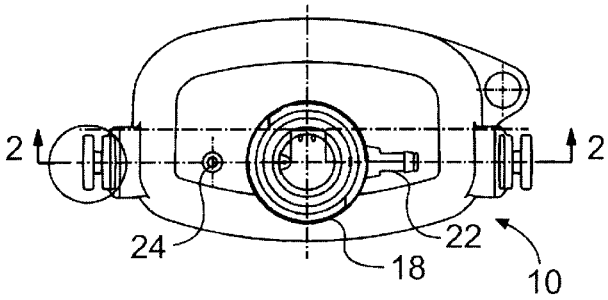
Figure 2:
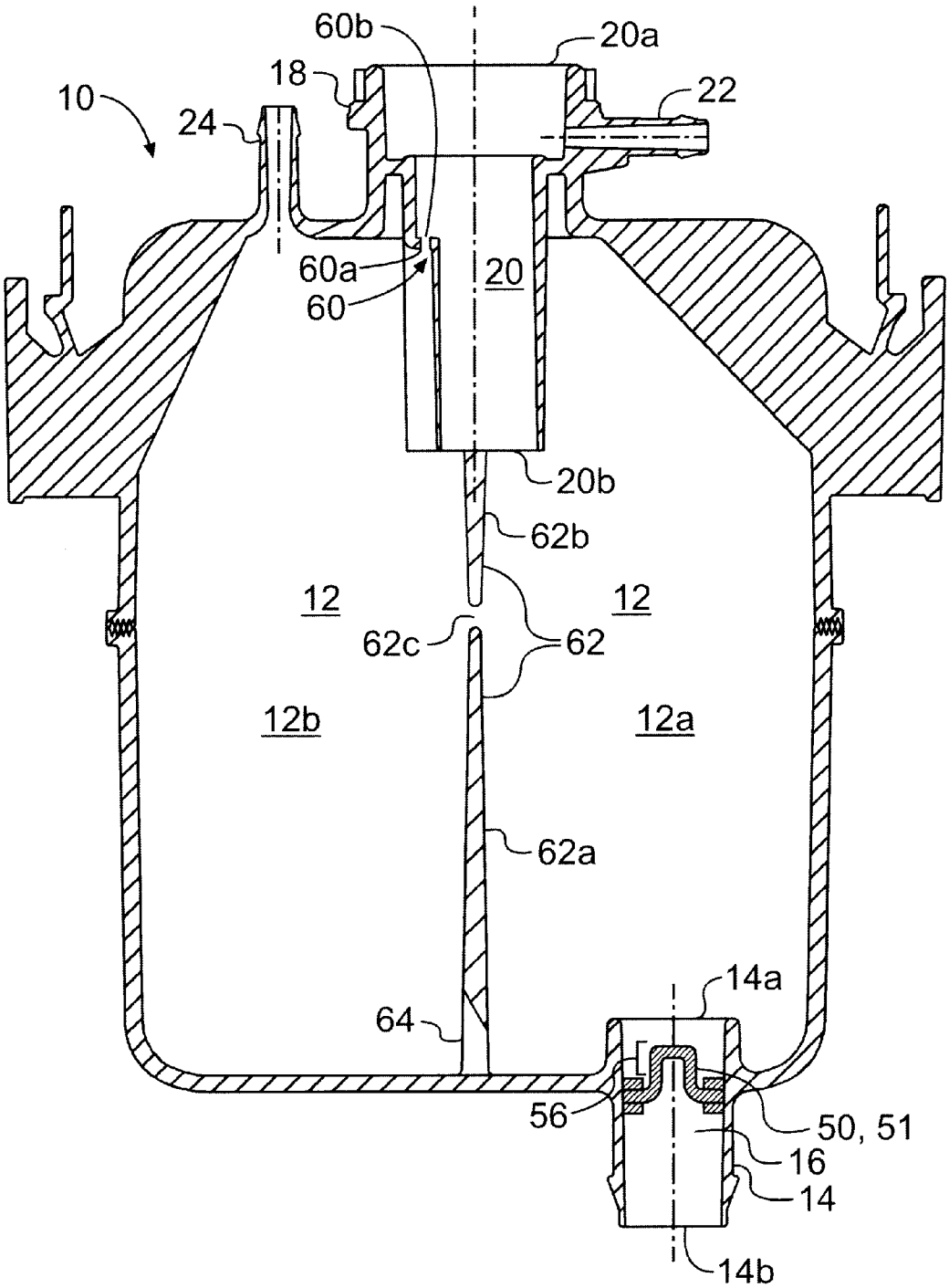
FIG. 2 is a cross-sectional view of the coolant reservoir of FIG. 1D taken along the line 2—2.

FIGS. 1A, 1B, 1C, and 1D illustrate front, side, back and top plan views, respectively, of a coolant reservoir 10 according to the present invention. FIG. 2 illustrates a cross-sectional view of the coolant reservoir 10 taken along the line 2—2 of FIG. 1D.

The coolant reservoir 10 comprises a container that defines a coolant receiving interior space 12. A main coolant port 14 extends downwardly from the lower end of the coolant reservoir 10 to form a flow aperture (or opening) 16 that connects to the interior space 12. A coolant filling port 18 extends upwardly from an upper end of the reservoir 10 and defines a hollow filling; tube 20 that allows a user to fill the reservoir 10 with coolant when necessary. An overflow port 22 is disposed at an upper end of the filling tube. A bleed port 24 is also disposed at an upper end of the reservoir 10.

Figure 3:
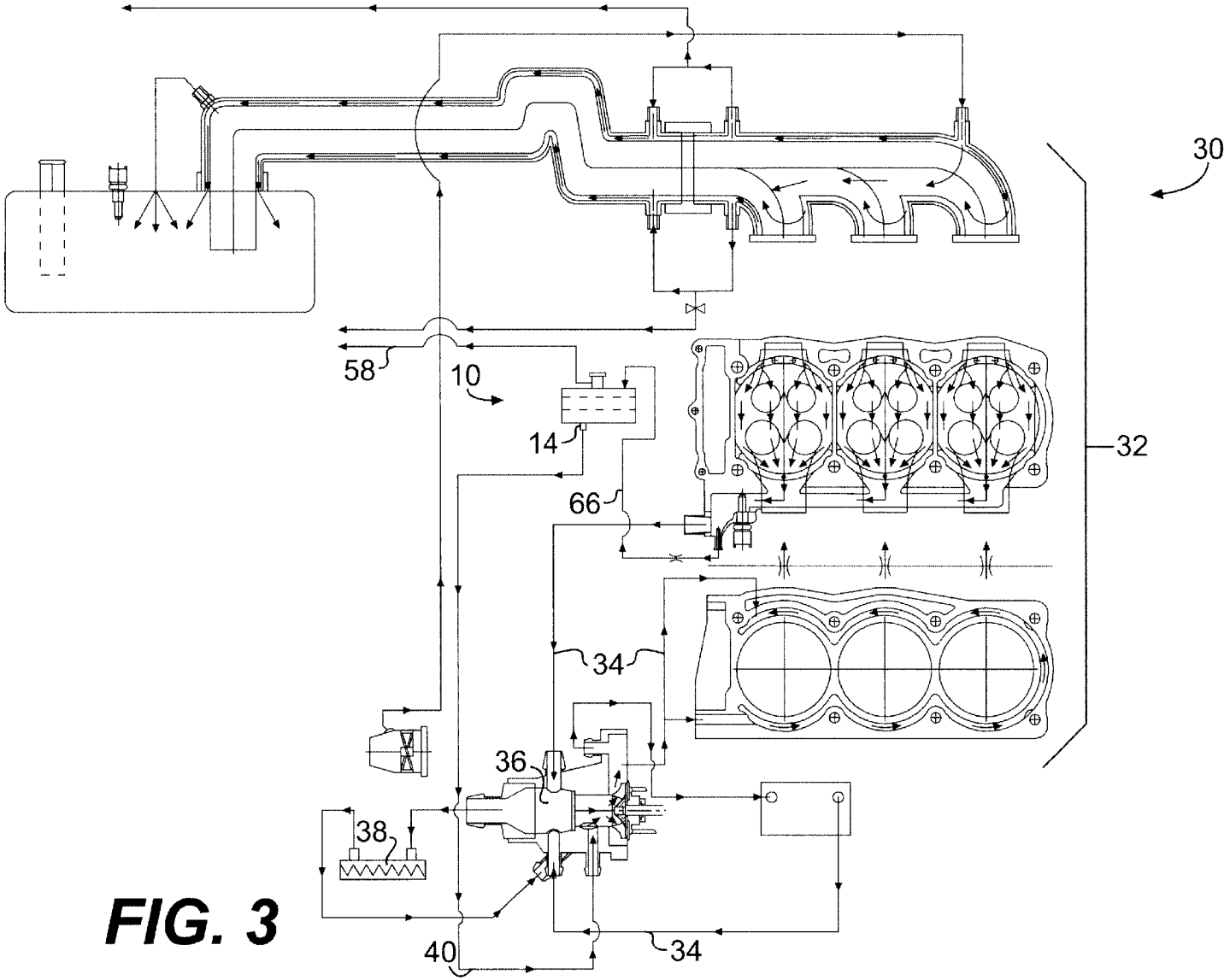
FIG. 3 is a schematic diagram of a coolant circulation system according to the present invention.

FIG. 3 illustrates a schematic diagram of a coolant circulation system 30 according to the present invention. The illustrated coolant circulation system 30 is a closed loop system that facilitates the circulation of a coolant. The coolant circulation system 30 can be used to cool the engine components 32 of various types of vehicles. In the illustrated embodiment, the coolant system 30 is used to cool the engine components 32 of a PWC. However, the coolant system 30 would be equally applicable to other types of vehicles such as all-terrain vehicles (ATVs) and snowmobiles, among others. The coolant circulation system 30 defines a coolant path 34 that flows through the engine components 32, a thermostat 36, and a heat exchanger 38. The engine components 32 may include an exhaust manifold, cylinder heads, or cylinder housing, etc. When coolant in the coolant path 34 flows through the engine components 32, the coolant absorbs heat, thereby cooling down the engine components 32. The heat absorbed by the coolant is subsequently dissipated in the heat exchanger 38. The volumetric flow of the coolant through the heat exchanger 38 and the engine components may be controlled by a thermostat 36 to regulate the temperature of the engine components 32.

As illustrated in FIG. 3, a connecting tube 40 is operatively connected to the coolant path 34 and removably connected to the main coolant port 14 of the coolant reservoir. When the reservoir is connected to the coolant circulation system 30, the reservoir 10 is disposed at a higher elevation than the engine 32. Pressure differences between the coolant path 34 and the reservoir 10 lend to force the coolant out of the reservoir 10 and into the coolant path 34 via the connecting tube 40 when the pressure in the reservoir 10 exceeds the pressure in the coolant path 34. Conversely, coolant tends to be forced out of the coolant path 34 and into the reservoir 10 via the connecting tube 40 when the pressure in the coolant path 34 exceeds the pressure in the reservoir 10.

Hereinafter, the main coolant port 14 and pressure-activated valve 50 will be described with reference to FIGS. 2, 4, and 6.

A pressure-activated valve 50 is mounted in the flow aperture 16 defined by the main coolant port 14. The pressure-activated valve 50 is designed to allow coolant to flow from the interior space 12 of the reservoir 10 out through the main coolant port 14 only when a pressure at an interior end 14*a* of the port 14 exceeds a pressure at an exterior end 14*b* of the port 14 by a first predetermined pressure gradient (or amount). To prevent coolant from leaking out through the port 14 when the reservoir 10 is disconnected from the coolant system 30, the first predetermined pressure gradient is preferably set such that the first predetermined pressure gradient is greater than a pressure gradient experienced when the reservoir 10 is full of coolant and the exterior end 14*b* of the main port 14 is oriented downwardly and exposed to the ambient environment, as would be the case when the reservoir 10 is being disconnected and removed. At the same time, the first predetermined pressure gradient is set low enough such that when the reservoir 10 is connected to the coolant system 30 and the pressure in the coolant system 30 is reduced (for example because of lack of coolant), the valve 50 will enable coolant in the reservoir 10 to flow through the main coolant port 14 into the coolant path 34 to maintain an adequate supply of coolant in the coolant system 30.

When the main coolant port 14 is operatively connected to the coolant system 30 via the connecting tube 40, the valve 50 also enables coolant to flow from the coolant path 34 into the interior space of the reservoir via the main coolant port 14 to compensate for a pressure increase within the coolant path 34. When pressure builds up in the coolant system 30, the valve 50 allows excess coolant to flow from the coolant system 30 into the reservoir 10 via the main coolant port 14. The valve 50 opens when a pressure at the exterior end 14*b* of the main coolant port 14 exceeds the pressure inside the reservoir (i.e., at the inside end 14*a* of the port 14) by a second predetermined pressure gradient (or amount). The second predetermined pressure gradient may be low or even zero to easily allow coolant to flow from the coolant system 30 into the reservoir 10.

The valve 50 is biased toward allowing coolant to enter the reservoir 10. To accomplish this, the first predetermined pressure gradient is set greater than the second predetermined pressure gradient.

Figure 4:
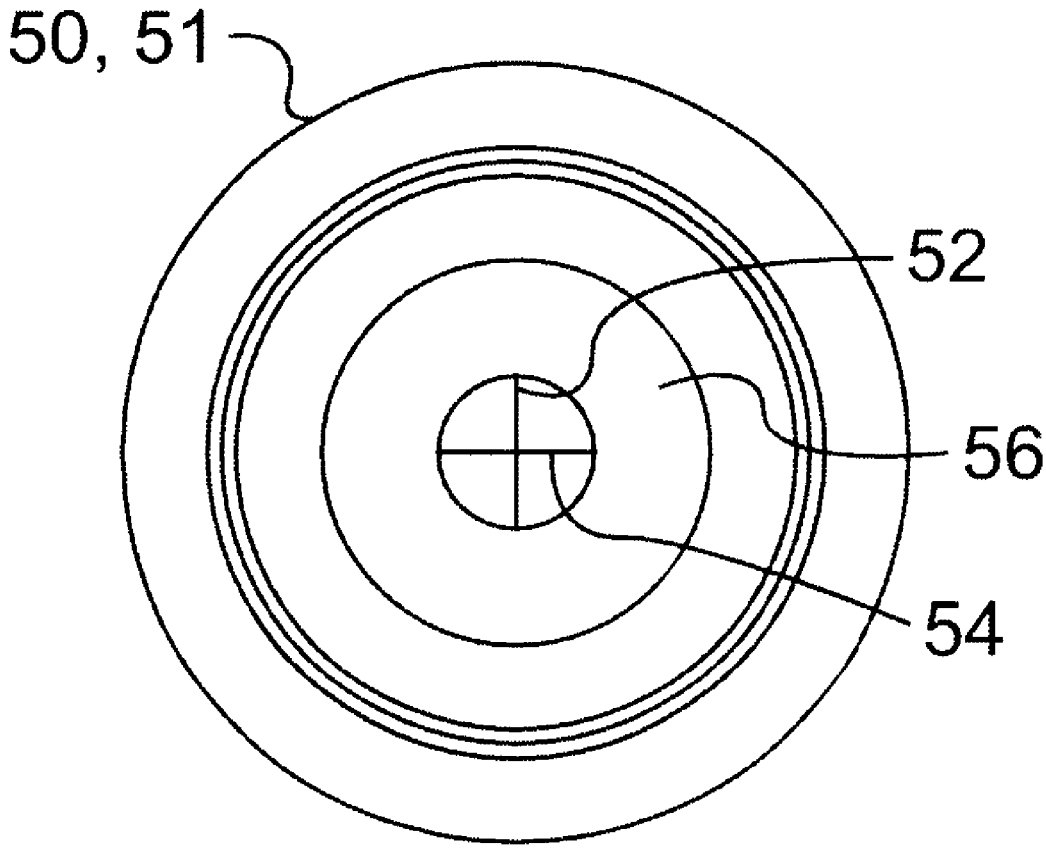
FIG. 4 is a bottom view of a diaphragm valve according to the present invention.
Figure 6:
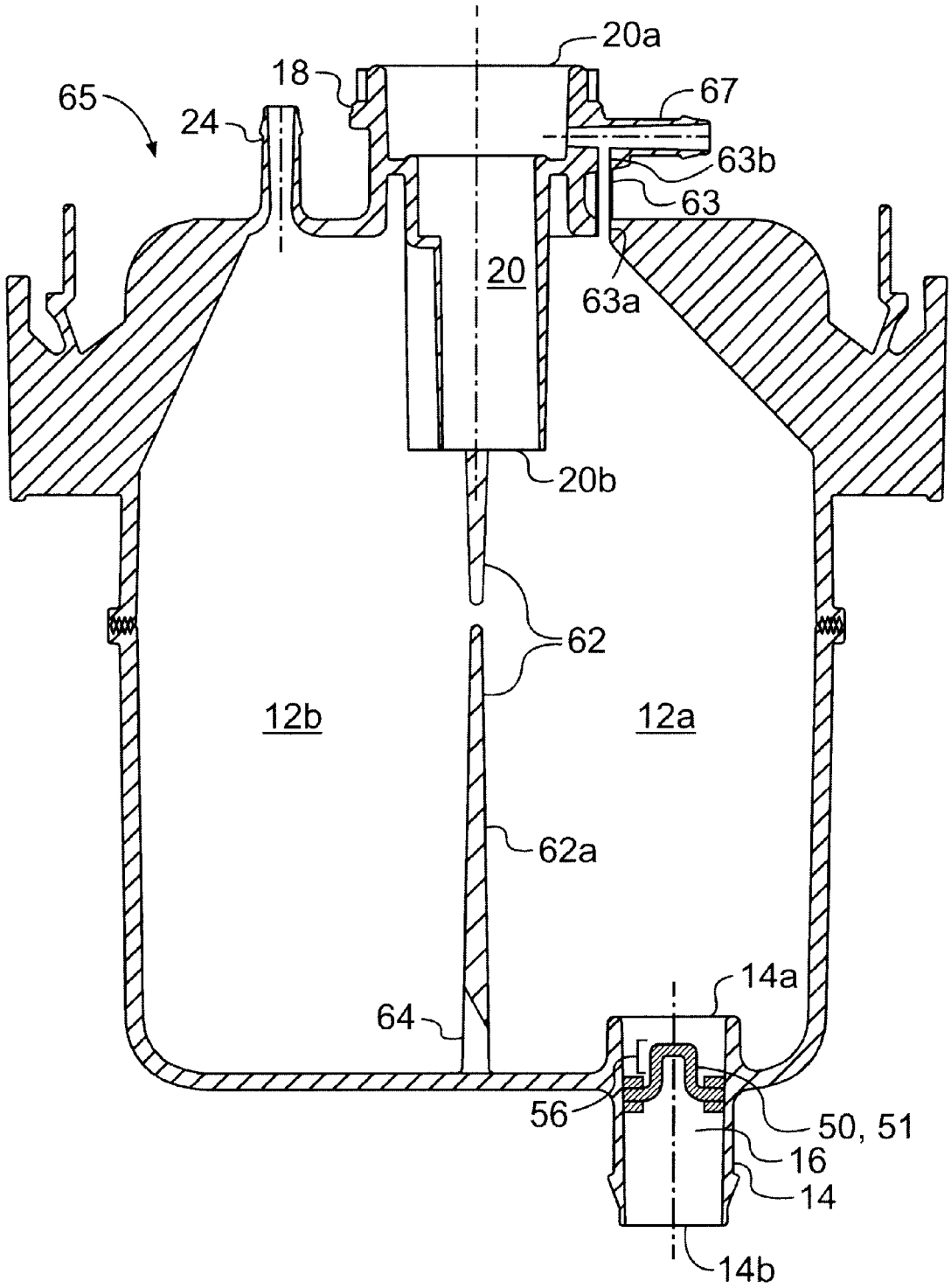
FIG. 6 is a cross-sectional view of an additional alternative embodiment of the present invention.

As illustrated in FIGS. 2, 4 and 6, the pressure-activated valve 50 of this embodiment comprises a flexible diaphragm 51. As best illustrated in FIG. 4, the diaphragm 51 includes first and second slits 52, 54 extending at least partially across a middle portion 56 of the diaphragm 51. The first and second slits 52, 54 are preferably perpendicular to each other. When a sufficient pressure gradient is experienced across the diaphragm 51, the slits 52, 54 spread apart and allow coolant to flow therethrough. It should be noted that just a single slit 52 could also be used without departing from the present invention, depending upon the pressure gradient desired. As would be appreciated by those skilled in the art, the greater the number of slits 52, 54, the easier coolant will flow through the diaphragm 51.

The middle portion 56 of the diaphragm 51 bulges toward the interior space 12 of the reservoir 10 when there is no pressure gradient across the diaphragm 51. This inward bulge ensures that the diaphragm 51 is biased toward allowing coolant to flow into the reservoir 10 (the first pressure gradient is greater than the second pressure gradient). When coolant pushes outward from inside the reservoir 10 because the pressure therein (at the inside end 14*a* of the port 14) is greater than the pressure at the outside end 14*b* of the main coolant port 14 by less than the first pressure gradient, the slits 52, 54 are pushed together, keeping the diaphragm 51 closed. However, when the pressure gradient exceeds the first predetermined pressure gradient (for example when the reservoir 10 is connected to the coolant system 30 and a lack of coolant in the coolant path 34 creates a partial vacuum), the slits 52, 54 bend outwardly toward the exterior end 14*b* of the main coolant port 14 and allow the coolant to flow therethrough into the connecting tube 40 and the coolant path 34.

While the illustrated embodiment uses a diaphragm 51 as the pressure-activated valve 50, any other suitable pressure-activated valve that would be known to one skilled in the art could also be used without departing from the spirit of the present invention. For example, a two-way check-valve having predetermined opening pressures could be positioned in the main coolant port 14. Alternatively, two oppositely-facing one-way check valves could be positioned in parallel relation to each other in the main coolant port 14.

When the reservoir 10 is disconnected and removed from the coolant system 30, the pressure-activated valve 50 substantially prevents coolant in the reservoir 10 from leaking out through the main coolant port 14. This non-leak feature is particularly advantageous in vehicles in which the coolant reservoir 10 must be removed in order to gain access to components usually associated with the engine. When a conventional reservoir without the valve 50 is used, a user must drain the coolant system and reservoir before removing the reservoir in order to prevent coolant from leaking out of the reservoir through the flow aperture onto the vehicle and/or engine as soon as the reservoir is disconnected. This non-leak feature is well-suited for use in such closed-loop coolant systems as are common in snowmobiles, personal watercraft, and ATVs, where the ability to remove the reservoir without draining the entire coolant system would be most helpful.

Figure 5:
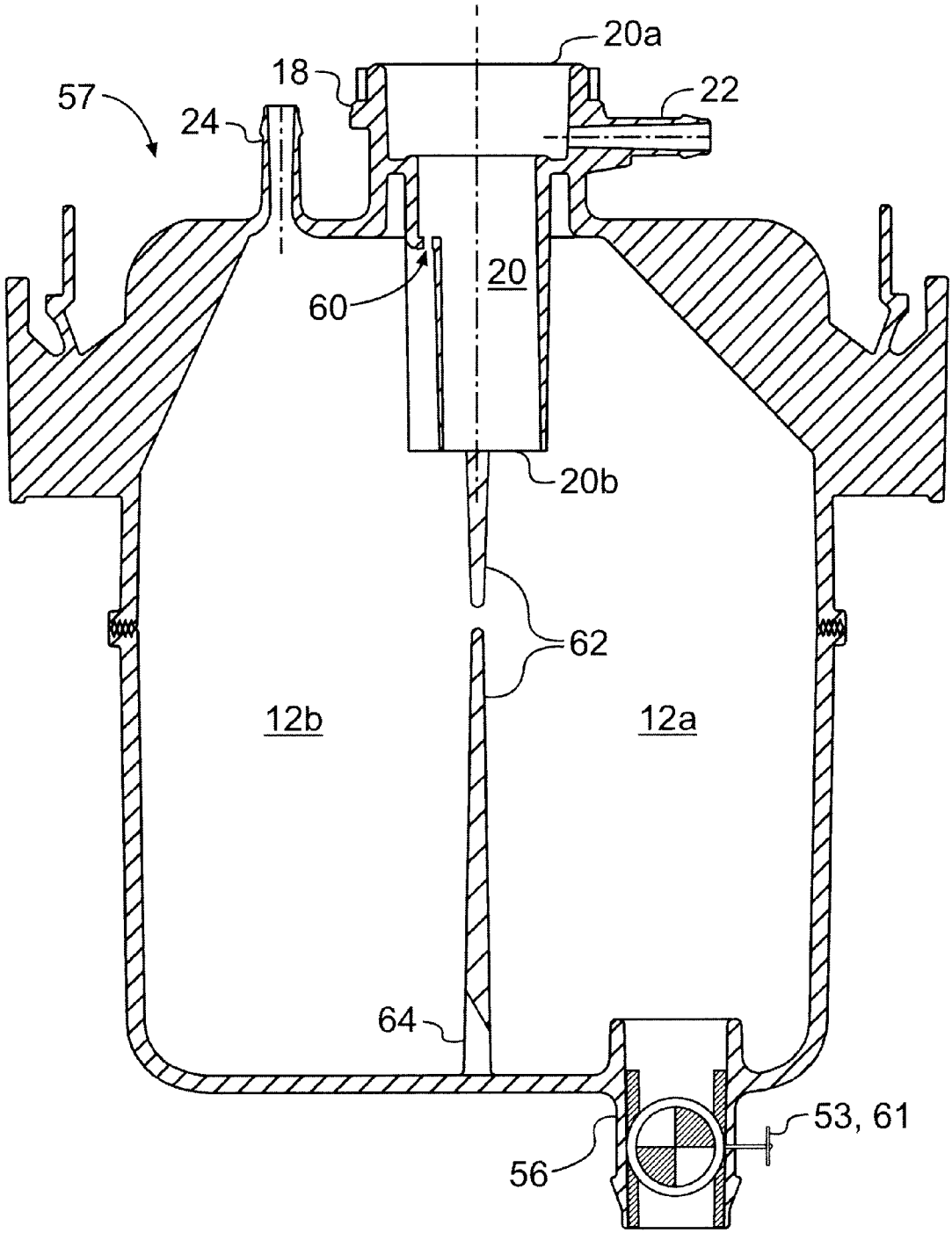
FIG. 5 is a cross-sectional view of an alternative embodiment of the present invention.

FIG. 5 illustrates an alternative embodiment of the invention. Where elements of this embodiment correspond exactly to elements of the previous embodiment, identical reference numerals are used. In this embodiment, a valve 53 is mounted in the main coolant port 55 of the reservoir 57. When a user connects the reservoir 57 to the coolant system 30, the valve 53 can be opened to allow coolant to flow between the reservoir 57 and the coolant path 34, as is required during normal operation of the coolant system 30. Conversely, when the reservoir 57 is operationally connected to the coolant path 34, the valve 53 can be closed so that the reservoir 57 can be disconnected without spilling the coolant or first draining the coolant system 30.

In the embodiment illustrated in FIG. 5, the valve 53 is a manually-operated ball valve 61. Before disconnecting the reservoir 57 from the coolant system 30, the user closes the ball valve 61. Conversely, after connecting the reservoir 57 to the coolant system 30, the user opens the ball valve to allow for coolant communication between the coolant path 34 and the reservoir 57.

While the illustrated valve 53 is a manually-operated ball valve 61, any other type of valve that would be known to one skilled in the art could also be used without departing from the scope of the present invention. For example, an automatically-closing quick-disconnect valve could be used as the valve 53. If a quick-disconnect valve is used, disconnecting the reservoir 57 from the coolant path 34 automatically closes the valve. Conversely, connecting the reservoir 57 to the coolant path 34 automatically opens the valve.

Hereinafter, the filling tube 20 will be described with reference to FIGS. 2 and 3.

The fluid filling port 18 comprises a hollow filling tube 20 that extends upwardly from an upper end of the reservoir 10. The filling tube 20 has an upper end 20*a* into which coolant may be added. A cap (not shown) is removably connected to the upper end 20*a* to prevent coolant and/or bubbles from spilling out through the upper end 20*a* when the coolant sloshes around in the reservoir 10. A lower end 20*b* of the filling tube 20 is disposed within the interior space 12 at a vertical position generally corresponding to a maximum desired fluid level. The maximum desired fluid level is preferably disposed at a predetermined position below the top of the interior space 12 so that a pocket of compressible gas is maintained within the coolant reservoir 10. The maximum desired coolant level 59 for this embodiment is marked on the front of the reservoir 10 as illustrated in FIG. 1A and generally corresponds to the vertical position of the lower end 20*b*. When a user fills the reservoir 10 with coolant through the filling tube 20 and the coolant level in the reservoir 10 is below the lower end 20*b* of the filling tube 20, displaced air inside the interior space 12 of the reservoir 10 escapes to the ambient environment through the lower end 20*b*. However, when the coolant level reaches and rises above the lower end 20*b* of the filling tube 20, displaced air can no longer escape through the lower end 20*b*. Consequently, additional coolant that is poured into the upper end 20*a* of the filling tube 20 accumulates in the filling tube 20.

An air escape passage 60 has a first end 60*a* that is operatively connected to the interior space 12. A second end 60*b* of the air escape passage 60 is connected to a portion of the filling tube 20 intermediate the upper and lower ends 20*a*, 20*b* thereof. Consequently, fluid and air can flow between the interior space 12 and the intermediate portion of the filling tube 20 via the air escape passage 60. The escape passage 60 has a cross-sectional area that is substantially smaller than a cross-sectional area of an inside of the filling tube 20. For example, the diameter of the air escape passage 60 in the illustrated embodiment is approximately 1 mm, as compared to the 22 mm diameter of the filling tube 20. These dimensions are illustrative only and are not meant to be limiting. As would be understood by one skilled in the art, the precise cross-sectional area of the air escape passage 60 is tuned to match the opening size and shape of the filling tube 20. For example, the cross-sectional shape of the air escape passage 60 and filling tube 20 will affect the gas and fluid flow rates therethrough. As described in greater detail below, the object is to provide an air escape passage 60 through which air flows at a substantially slower rate than coolant may be introduced into the reservoir 10 through the filling tube 20.

The escape passage 60 enables displaced air to gradually escape from the interior space through the escape passage 60 and upper end 20*a*. As a result, when the coolant level is above the lower end 20*b* of the filling tube 20, fluid accumulated in the filling tube 20 gradually flows into the interior space 12 as the displaced air gradually escapes through the escape passage 60.

When a user fills the reservoir 10 with coolant, the user may not be able to keep careful track of the coolant level in the reservoir 10. The user may therefore fill the reservoir 10 above the maximum desired coolant level 59. When this happens, the coolant level rises above the lower end 20*b* and stops displaced air from escaping through the lower end 20*b*. As a result, instead of having the coolant level gradually rise in the wide area of the main interior space 12, the coolant level quickly rises in the relatively narrow cross-sectional space within the filling tube 20. The coolant level in the filling tube 20 rapidly rises and indicates to the user that the maximum desired coolant level has been reached. The user thereafter stops filling the reservoir 10, the observed coolant level in the filling tube 20 having informed the user that the maximum desired coolant level has been reached. Finally, the air escape passage 60 allows the coolant that accumulated in the filling tube 20 to flow into the interior space 12 as displaced air escapes through the air passage 60 and upper end 20*a*. After filling the reservoir, the user replaces the cap.

Hereinafter, the overflow port 22 and tube 58 will be described with reference to FIGS. 2 and 3. The overflow port 22 is operatively connected to the filling tube 20 near but slightly below the upper end 20*a*. The overflow tube 58 is removably operatively connected at one end to the external end of the overflow port 22. The opposite end of the overflow tube 58 is disposed in an area where spilled coolant will do little or no harm. For example, in a PWC, the free end of the overflow tube 58 may be disposed at a bottom of the hull of the PWC (e.g., a bilge area) away from the other components of the PWC.

As noted above with respect to the filling tube 20, the coolant level in the filling tube 20 can rise quickly up to the upper end 20*a*. As discussed above, the reservoir 10 in a PWC may be disposed above the engine or other vital component(s). In such a case, it is advantageous to prevent excess coolant from spilling out of the reservoir 10 at the upper end 20*a*. The overflow port 22 and tube 58 prevent just such a spill. When the coolant level rises in the filling tube 20 to the level of the overflow port 22 while the user is filling the reservoir and the cap is removed, excess coolant flows through the overflow port 22, which is disposed below the top rim of the upper end 20*a* of the filling tube 20, instead of out of the upper end 20*a*. The excess coolant flows through the overflow tube 58 and is discharged in a location where damage and mess is minimized. In the case of a PWC, the external end of the overflow tube 58 is disposed at a bottom of the hull (e.g., in the bilge area).

The cap (not shown) is preferably a type SAE-J164 cap and serves as a pressure regulator for the reservoir 10. The cap is a spring-loaded pressure cap that normally covers the overflow port 22 and prevents coolant and air from exiting the reservoir 10 via the overflow port. However, when a predetermined pressure develops in the reservoir 10, a spring-loaded portion of the cap lifts slightly and uncovers the overflow port 22 such that excess pressurized gas and/or coolant (if the coolant level is sufficiently high) in the reservoir 10 can escape via the overflow port 22.

The positioning of the discharge end of the overflow tube 58 at the bottom of the PWC's hull serves a second function. If a PWC having the coolant reservoir 10 flips over, coolant would not spill out because the external end of the overflow tube 58 would then be disposed at a higher elevation (now the bottom of the hull of the PWC) than the coolant reservoir 10, itself.

Hereinafter, an alternative embodiment of the present invention will be described with reference to FIG. 6. Where the embodiment illustrated in FIG. 6 is identical to the previous embodiment, the same reference numerals are used in order to avoid redundant descriptions of the common elements. Like the previous embodiment, an air escape passage 63 according to the present embodiment has a first end 63*a* operatively connected to the interior space 12 of the reservoir 65. Unlike the previous embodiment, however, a second end 63*b* of the air escape passage 63 is operatively connected to the overflow tube 58 via the overflow port 67. In the illustrated embodiment, the passage 63 is integrally formed with the reservoir 65. However, the passage 63 could also comprise a separate tube that connects a port in the overflow port 67 to a port in the interior space 12. In the present embodiment, a pressure-activated valve (not shown) is preferably disposed in the overflow tube 58 between the second end 63*b* and the discharge end of the overflow tube 58 so that gas and/or coolant does not escape through the escape passage 63 during use of the reservoir 65 unless a predetermined pressure builds up within the reservoir 65. When the cap is removed and the reservoir 65 is filled with coolant, however, air can escape from the interior space 12 to the upper end 20*a* of the filling tube via the air escape passage 63 and overflow port 67.

While in the illustrated embodiments, the second end 60*b*, 63*b* of the air escape passage 60, 63 connects to either the filling tube 20 or the overflow tube 58, the second end of the air escape passage could also connect to a variety of other places without departing from the scope of the present invention. For example, the second end of the air escape passage could lead directly to the ambient environment outside the reservoir. Regardless of the specific structure employed, the goal of the air escape passage is to allow fluid to be added to the reservoir through the filling tube 20 at a substantially faster rate than air can escape from the reservoir through the air escape passage.

Hereinafter, the bleed port 24 and barrier 62 of the coolant reservoir 10 will be described with reference to FIGS. 2 and 3.

As can be seen in FIG. 2, a barrier 62 partially separates the interior space 12 of the reservoir 10 into first and second lateral interior spaces 12*a*, 12*b*. The barrier 62 extends upwardly from the bottom of the interior space 12. In the illustrated embodiment, the barrier 62 includes a lower portion 62*a* and an upper portion 62*b* that are separated by a small gap 62*c* formed in the barrier 62. The lower portion 62*a* terminates below the filling tube 20 at an elevation slightly above a vertical middle of the interior space 12. The upper portion 62*b* extends upwardly from a top of the gap 62*c* to the lower end 20*b* of the filling tube 20 and structurally reinforces the reservoir 10. It should be noted that the upper portion 62*b* of the barrier 62 and/or the gap 62*c* may be omitted without deviating from the scope of the present invention. Furthermore, the barrier 62 could extend from and to various other vertical points within the interior space 12, the purpose being that coolant below the top of the barrier 62 is discouraged from quickly flowing back and forth between the first and second lateral interior spaces 12*a*, 12*b*. A coolant passage 64 operatively connects lower portions of the first and second lateral interior spaces 12*a*, 12*b* to allow coolant to gradually flow back and forth between the lower portions of the first and second interior spaces 12*a*, 12*b*. The main coolant port 14 is disposed in the lower portion of the first lateral interior space 12*a*. A bleed port 24 is operatively connected to an upper end above the second interior space 12*b*.

As illustrated in FIG. 3, a bleed tube 66 is removably operatively connected to the bleed port 24 and operatively connected to the coolant path 34 at a location on the coolant path 34 just before the coolant leaves the engine 32 to return to the thermostat 36. This location is the highest and hottest position along the coolant path 34 and is consequently a natural place for bubbles to develop and accumulate.

Hereinafter, the functionality of the barrier 62 will be described. The inventors of the present invention developed the barrier 62 and relative positioning of the reservoir 10 components in order to keep the coolant path 34 as bubble-free as possible. The first end of the bleed tube 66 is connected to the coolant path 34 where bubbles accumulate so that the bubbles accumulating in this area flow through the bleed tube 66 and into the second lateral interior space 12*b* via the bleed port 24. Some of the bubbles may condense in the bleed tube 66 and splash down into the second lateral interior space 12*b* as coolant. The splashing coolant creates additional bubbles in the second lateral interior space 12*b*. Because the bleed port 24 is disposed at an upper end of the second lateral space 12*b*, the bubbles tend to stay in the upper portion of the interior space 12. The barrier 62 limits flow between the first and second interior spaces 12*a*, 12*b* in order to discourage bubbles that enter the second lateral space 12*b* through the bleed port 24 from entering the first lateral space 12*a*, especially when the coolant level within the reservoir 10 falls below the top of the barrier 62. Because bubbles tend to move upward, the fluid passage 64, which connects lower portions of the first and second lateral interior spaces 12*a*, 12*b*, permits only a substantially bubbleless coolant in the lower portion of the second interior space 12*b* to flow into the first lateral interior space 12*a*. Finally, the main coolant port 14 is disposed at the lower end of the first lateral interior space 12*a*, which, for the reasons stated herein, is maintained relatively bubble-free. Consequently, bubbles that are formed in the second lateral space 121) or migrate to the second lateral space 12*b* by way of the bleed tube 66 and port 24 tend not to flow back into the coolant path 34 through the main coolant port 14.

While the disclosed embodiment of the present invention is used in conjunction with a closed-loop coolant system 30, the invention would work equally well with various other fluid systems that are known in the art.

The foregoing illustrated embodiments are provided to illustrate the structural and functional principles of the present invention and are not intended to be limiting. To the contrary, the principles of the present invention are intended to encompass any and all changes, alterations and/or substitutions within the spirit and scope of the following claims.

What is claimed is:

1. A fluid reservoir for removable connection to a fluid system in a vehicle, said fluid system defining a fluid path through which a fluid flows, said reservoir comprising:

a container defining a fluid receiving interior space and having a flow aperture, said container being constructed to be removably connected to said fluid system of said vehicle to allow for fluid communication between said interior space of said container and said fluid path via said flow aperture; and a valve mounted to the container at said flow aperture, wherein said valve substantially prevents said fluid in said interior space of said container from flowing out through said flow aperture when an exterior portion of said valve is exposed to ambient air, and wherein said valve is a pressure-activated valve that allows said fluid to flow from said interior space into said fluid path via said flow aperture only if a pressure within said interior space exceeds a pressure outside of said interior space by a first predetermined amount, and wherein said first predetermined amount is greater than a pressure across said valve when said container is full of fluid and said flow aperture is exposed to ambient air.

2. The fluid reservoir of claim 1, wherein said valve has open and closed positions, and wherein the valve substantially prevents said fluid in said container from flowing out through said flow aperture when said valve is closed.

3. A fluid reservoir for removable connection to a fluid system in a vehicle, said fluid system defining a fluid path through which a fluid flows, said reservoir comprising:

a container defining a fluid receiving interior space and having a flow aperture, said container being constructed to be removably connected to said fluid system of said vehicle to allow for fluid communication between said interior space of said container and said fluid path via said flow aperture; and a valve mounted to the container at said flow aperture, wherein said valve substantially prevents said fluid in said interior space of said container from flowing out through said flow aperture when an exterior portion of said valve is exposed to ambient air, wherein said valve is a pressure-activated valve and wherein said pressure-activated valve allows said fluid to flow from said interior space into said fluid path via said flow aperture only if a pressure within said interior space exceeds a pressure outside of said interior space by a first predetermined amount and also allows fluid to flow from said fluid path into said interior space via said flow aperture only if a pressure in said fluid path exceeds said pressure within said interior space by a second predetermined amount.

4. The fluid reservoir of claim 3, wherein said first amount is greater than said second predetermined amount.

5. The fluid reservoir of claim 3, wherein said valve comprises a flexible diaphragm having at least one slit extending at least partially across a middle portion of said diaphragm.

6. The fluid reservoir of claim 5, wherein said at least one slit comprises two slits.

7. The fluid reservoir of claim 6, wherein said middle portion of said diaphragm bulges toward said interior space when there is no pressure gradient across said valve.

8. A vehicle comprising:

a fluid system defining a fluid path through which a fluid is circulated; and a fluid reservoir in fluid communication with said fluid path, said fluid reservoir comprising a container defining a fluid receiving interior space and having a flow aperture that allows for communication between said interior space of said container and said fluid path;

a filling tube having (a) a first end into which fluid may be added and (b) a second end disposed within said interior space at a vertical position generally corresponding to a maximum desired fluid level; and an air escape passage having first and second ends, said second end of said air escape passage being disposed higher than said second end of said filling tube, said first end of said air escape passage communicating with said interior space, said passage having a cross-sectional area substantially smaller than a cross-sectional area of an interior of said filling tube, whereby said filling tube enables air that is displaced during fluid filling to escape from said interior space to an ambient environment until a fluid level in said interior space reaches said second end, whereupon said second end causes said fluid to accumulate in said filling tube when said fluid level is above said second end of said filling tube, and whereby said escape passage enables air to gradually escape from said interior space of said container so that said fluid accumulated in said filling tube gradually flows into said interior space when said fluid level is above said second end of said filling tube, and wherein said second end of said air escape passage communicates with a portion of said filling tube intermediate said first and second ends thereof.

9. The vehicle of claim 8, wherein said vehicle comprises an engine for propelling said vehicle and said fluid reservoir is disposed above said engine.

10. A vehicle comprising:

a fluid system defining a fluid path through which a fluid is circulated; and a fluid reservoir in fluid communication with said fluid path, said fluid reservoir comprising a container defining a fluid receiving interior space and having a flow aperture that allows for communication between said interior space of said container and said fluid path;

a filling tube having (a) a first end into which fluid may be added and (b) a second end disposed within said interior space at a vertical position generally corresponding to a maximum desired fluid level; and an air escape passage having first and second ends, said second end of said air escape passage being disposed higher than said second end of said filling tube, said first end of said air escape passage communicating with said interior space, said passage having a cross-sectional area substantially smaller than a cross-sectional area of an interior of said filling tube, whereby said filling tube enables air that is displaced during fluid filling to escape from said interior space to an ambient environment until a fluid level in said interior space reaches said second end, whereupon said second end causes said fluid to accumulate in said filling tube when said fluid level is above said second end of said filling tube, and whereby said escape passage enables air to gradually escape from said interior space of said container so that said fluid accumulated in said filling tube gradually flows into said interior space when said fluid level is above said second end of said filling tube, and wherein said reservoir further comprises an overflow port at an upper portion of said filling tube.

11. The vehicle of claim 10, wherein said fluid system further comprises an overflow tube removably fluidly communicating with an external end of said overflow port to permit excess fluid in said filling tube to flow through said overflow port and tube to a predetermined location.

12. The vehicle of claim 11, wherein said second end of said air escape passage communicates with said overflow tube.

13. The vehicle of claim 10, wherein said second end of said air escape passage fluidly communicates with said overflow port.

14. The vehicle of claim 11, wherein said vehicle is a personal watercraft and said predetermined location is a bottom of a hull of said personal watercraft.

15. The vehicle of claim 8, wherein said fluid system comprises a closed-loop fluid circulation system.

16. The vehicle of claim 8, wherein said fluid system is a coolant circulation system.

17. The vehicle of claim 8, wherein said vehicle is an ATV.

18. The vehicle of claim 8, wherein said vehicle is a snowmobile.

19. A fluid reservoir for removable fluid communication with a fluid system in a vehicle, said fluid system defining a fluid path through which a fluid flows, said fluid reservoir comprising:

a container defining a fluid receiving interior space and having a flow aperture constructed to be removably connected to said fluid path to allow for fluid communication between said interior space of said container and said fluid path via said flow aperture;

a filling tube having (a) a first end into which fluid may be added and (b) a second end disposed within said interior space at a vertical position generally corresponding to a maximum desired fluid level; and an air escape passage having first and second ends, said first end of said air escape passage communicating with said interior space, said passage having a cross-sectional area substantially smaller than a cross-sectional area of an inside of said filling tube, whereby said filling tube enables air that is displaced during fluid filling to escape from said interior space to an ambient environment through said second end of said filling tube until a fluid level in said interior space reaches said second end of said filling tube, whereupon said second end of said filling tube causes said fluid to accumulate in said filling tube when said fluid level is above said second end of said filling tube, and whereby said escape passage enables air to gradually escape from said interior space so that said fluid accumulated in said filling tube gradually flows into said interior space when said fluid level is above said second end of said filling tube, and wherein said second end of said air escape passage communicates with a portion of said filling tube intermediate said first and second ends thereof.

20. A fluid reservoir for removable fluid communication with a fluid system in a vehicle, said fluid system defining a fluid path through which a fluid flows, said fluid reservoir comprising:

a container defining a fluid receiving interior space and having a flow aperture constructed to be removably connected to said fluid path to allow for fluid communication between said interior space of said container and said fluid path via said flow aperture;

a filling tube having (a) a first end into which fluid may be added and (b) a second end disposed within said interior space at a vertical position generally corresponding to a maximum desired fluid level; and an air escape passage having first and second ends, said first end of said air escape passage communicating with said interior space, said passage having a cross-sectional area substantially smaller than a cross-sectional area of an inside of said filling tube, whereby said filling tube enables air that is displaced during fluid filling to escape from said interior space to an ambient environment through said second end of said filling tube until a fluid level in said interior space reaches said second end of said filling tube, whereupon said second end of said filling tube causes said fluid to accumulate in said filling tube when said fluid level is above said second end of said filling tube, and whereby said escape passage enables air to gradually escape from said interior space so that said fluid accumulated in said filling tube gradually flows into said interior space when said fluid level is above said second end of said filling tube, and wherein said reservoir further comprises an overflow port disposed at an upper portion of said filling tube such that when a fluid height in said filling tube reaches said overflow port, said fluid flows out of said filling tube through said overflow port.

21. The reservoir of claim 20, wherein said second end of said air escape passage is in fluid communication with said overflow port.

22. The vehicle of claim 10, wherein said vehicle comprises an engine for propelling said vehicle and said fluid reservoir is disposed above said engine.

23. The vehicle of claim 10, wherein said fluid system comprises a closed-loop fluid circulation system.

24. The vehicle of claim 10, wherein said fluid system is a coolant circulation system.

25. The vehicle of claim 10, wherein said vehicle is an ATV.

26. The vehicle of claim 10, wherein said vehicle is a snowmobile.

27. The fluid reservoir of claim 3, wherein said valve has open and closed positions, and wherein the valve substantially prevents said fluid in said container from flowing out through said flow aperture when said valve is closed.

28. The fluid reservoir of claim 1, wherein said valve comprises a flexible diaphragm having at least one slit extending at least partially across a middle portion of said diaphragm.

29. The fluid reservoir of claim 28, wherein said at least one slit comprises two slits.

30. The fluid reservoir of claim 29, wherein said middle portion of said diaphragm bulges toward said interior space when there is no pressure gradient across said valve.

31. The fluid reservoir of claim 31, in combination with a vehicle having said fluid system.

32. The fluid reservoir of claim 31, wherein said vehicle is one of a personal watercraft, a snowmobile, and an all terrain vehicle.

33. The fluid reservoir of claim 31, wherein said fluid system comprises a closed-loop fluid circulation system.

34. The fluid reservoir of claim 33, wherein said fluid system comprises a coolant circulation system.

35. The fluid reservoir of claim 31, further comprising an engine, wherein said fluid reservoir is disposed above said engine when connected to said fluid system.

36. The fluid reservoir of claim 3, in combination with a vehicle having said fluid system.

37. The fluid reservoir of claim 36, wherein said vehicle is one of a personal watercraft, a snowmobile, and an all terrain vehicle.

38. The fluid reservoir of claim 36, wherein said fluid system comprises a closed-loop fluid circulation system.

39. The fluid reservoir of claim 38, wherein said fluid system comprises a coolant circulation system.

40. The fluid reservoir of claim 36, further comprising an engine, wherein said fluid reservoir is disposed above said engine when connected to said fluid system.

* * * * *